United States Patent [19]

Iwasawa

[11] 4,218,591

[45] Aug. 19, 1980

[54] PHONOGRAPH CARTRIDGE WITH VERY HARD METAL CERAMIC FRAME

[76] Inventor: Tadashi Iwasawa, 5-26-8, Himonyo, Meguro-ku, Tokyo, Japan

[21] Appl. No.: 948,431

[22] Filed: Oct. 4, 1978

[30] Foreign Application Priority Data

Mar. 25, 1978 [JP] Japan ..... 53-33625

[51] Int. Cl.[2] ..... H04R 9/12; H04R 11/08

[52] U.S. Cl. ..... 179/100.41 R; 179/100.41 D; 179/100.41 M

[58] Field of Search ..... 179/100.41 K, 100.41 D, 179/100.41 M, 100.41 Z

[56] References Cited

U.S. PATENT DOCUMENTS

| | | | |
|---|---|---|---|
| 3,040,136 | 6/1962 | Grado | 179/100.41 K |
| 3,060,281 | 10/1962 | Snepvangers | 179/100.41 K |
| 3,077,521 | 2/1963 | Aherns et al. | 179/100.41 K |
| 3,297,831 | 1/1967 | Stanton | 179/100.41 K |
| 3,679,843 | 7/1972 | Cho | 179/100.41 K |
| 3,963,880 | 6/1976 | Ikeda | 179/100.41 K |
| 4,124,782 | 11/1978 | Schön | 179/100.41 K |
| 4,145,582 | 3/1979 | Nakatsuka | 179/100.41 K |

*Primary Examiner*—Raymond F. Cardillo, Jr.
*Attorney, Agent, or Firm*—Frishauf, Holtz, Goodman & Woodward

[57] ABSTRACT

A pick up cartridge which comprises a cantilever at the end of which is mounted, a stylus a generating mechanism which is fixed near the supporting point of the cantilever, a pair of yokes which give a magnetic field to the generating mechanism, and a holder which holds the yokes directly and/or indirectly, wherein at least a part of said holder is made of very hard metal ceramic material. Viscoelastic material is also used to reduce harmful vibrations in the cartridge.

11 Claims, 2 Drawing Figures

PHONOGRAPH CARTRIDGE WITH VERY HARD METAL CERAMIC FRAME

BACKGROUND OF THE INVENTION

This invention relates to an improved high fidelity phonograph pick up cartridge.

Prior art magnetic cartridges for phonographs are of two types. One type is the moving coil type which has a moving coil driven by a cantilever, and the other type is the moving magnet type which has a moving magnet driven by a cantilever.

A magnetic cartridge operates corresponding to the movement of a stylus which is at the end of the cantilever and a moving member in the generating mechanism which is located near the supporting point of the cantilever. The moving member vibrates in accordance with the trace of the recorded disk tracks by the stylus.

The vibrating energy is transmitted to yokes, which energy spreads to a magnet attached to the yokes. The energy also spreads to a holder which fixed the yokes on the bottom of the casing of cartridge. Finally the energy is radiated to the outside atmosphere through the head shell which is holding the cartridge.

The part of the yoke which is near the generating mechanism is supported not to be in contact with the inside wall of the casing. The aforementioned vibrating energy involves undesired resonance or reflection signals which are fed back to the generating mechanism to produce harmful signal components.

In the prior art, no effective means to reduce such harmful vibrations is considered, so that it is impossible to regenerate high fidelity audio signal from recorded tracks of the disks.

SUMMARY OF THE INVENTION

A main object of this invention is to provide a phonograph pick up cartridge which is to reproduce high fidelity audio signals.

Another object of this invention is to effectively reduce the harmful vibrations which may occur due to supporting the yokes by very hard ceramic materials directly or indirectly.

Still another object of this invention is to hold the fulcrum point of the yoke directly with very hard ceramic materials and to reduce the harmful vibration effectively.

Another object of this invention is to effectively reduce the harmful vibrations which may occur due to constructing the inner wall of the casing which is very near to the yokes by very hard ceramic materials by using viscoelastic material to support the yokes indirectly.

DETAILED DESCRIPTION

Figure 1:
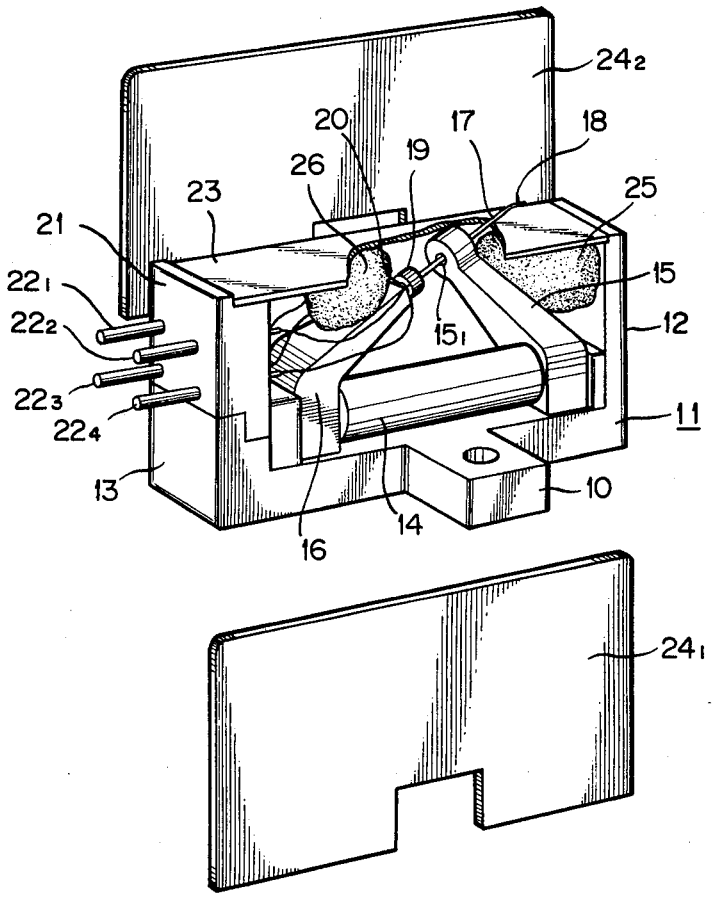
FIG. 1 shows a partially broken away perspective view of one embodiment of this invention.

Referring to FIG. 1, the frame (11), which has a fixture (10) and two oppositely facing side walls (12) and (13), may be made partly of metalic material and partly of very hard ceramic material. Between the two side walls (12) and (13) is mounted a cylindrical magnet (14). At both ends of the magnet (14) toward the side walls (12) and (13), two yokes (15) and (16) are mounted, an end of each yoke being fixed to the frame (11), which acts as a holder. The yokes (15) and (16) extend upwardly (in FIG. 1) and at the end of the yoke (15) a through hole ($15_1$) is formed. Through this hole ($15_1$), a cantilever (17) is extended to the outside of frame (11). On the top end of the cantilever is mounted a stylus which traces on the tracks of recorded disks.

The supporting point of the cantilever (17) is on the top of the other yoke (16) and the cantilever is supported in a small hole which is formed on the top of the yoke (16) (not shown). At the center of the supporting point a small string of elastic wire is fixed and the wire is held through the small hole formed on the top of the yoke (16). The cantilever, therefore, is pivotally fixed at the supporting point. Next to the supporting point of the cantiliver (17), adjacent the top end of yoke (16), is mounted a moving coil (19). A piece of damper material (20) is placed between the yoke (16) and the coil (19).

On the upper side of the side wall (13) an insulated terminal support (21) is adhered. The terminal support (21) forms a part of the side wall (13). Four leads ($21_1$)-($21_4$) extend through the terminal support (21) and are connected to the coil (19). On the top side of the frame (11) which holds these components, that is on the tops of the side walls (12) and (13), a metallic protecting plate (23) is bridged and fixed. On both open sides of the frame (11) side members ($24_1$) and ($24_2$), which are made of ceramic material, are mounted or, bonded to the frame (11) to constitute a casing in combination with the frame.

According to this invention one more important improvement is made on this moving coil type of cartridge. That is, into the space, which is formed between the yoke (15), the side wall (12) the protecting plate (23), and a pair of side members ($24_1$) and ($24_2$), silicone rubber grease (R.T.V.), which becomes solid at room temperature, is injected to form a viscoelastic material layer (25). Layer (25) contacts the yoke (15) to indirectly absorb vibrations of the yoke (15) and to prevent it from reflecting or resonating the vibrations.

Layer (25) may be made of a simple rubber or other elastic material and will still be effective, but silicone rubber grease which cures to the elastic state after injection is the most preferable.

Additionally, to the yoke (16) a viscoelastic material layer (26) is also formed by silicone rubber grease and it also prevents harmful feedback from the side walls ($24_1$) and ($24_2$) to the generating mechanism.

Ceramic materials used are preferably selected from nitride ceramics such as silicone nitride ($Si_3N_4$), titanium nitride (TiN), zirconium nitride (ZrN), aluminum nitride (AlN), boron nitride (BN), or from metallic oxide ceramic such as crystalline almina ($Al_2O_3$), and sapphire. Referring to Table 1, the velocity of sound waves travelling in these materials is two or three times faster than that in metals and plastics, and undesired harmful waves fed back to the generating mechanism can be diffused to a cartridge shell through the casing. As the viscoelastic materials are attached to these components, the harmful vibrations are attenuated to regenerate high fidelity signals.

Table 1

| Material | Density ($g/cm^3$) | Sound velocity (Km/s) | Sound velocity divided by density ($Km.cm^3/g.s$) | Bending strength ($Kg/mm^2$) |
|---|---|---|---|---|
| Epoxy resin | 1.175 | 2.13 | 1.90 | 10–15 |
| Epoxy resin incorporated with tungsten powder | 3.9 | 1.67 | 0.42 | 10–15 |
| Acrylic resin | 1.18 | 2.65 | 2.24 | 10 |
| Aluminum | 2.69 | 6.42 | 2.38 | *6–12 |
| Brass | 8.6 | 4.70 | 0.54 | *28–53 |
| Stainless steel | 7.91 | 5.79 | 0.73 | *53 |
| Iron | 7.86 | 5.9 | 0.75 | *32–55 |
| Sintered alumina | 3.96 | 10.8 | 2.72 | 60 |
| Silicone nitride | 3.27 | 11.0 | 3.36 | 126 |

*Tensile strength ($Kg/mm^2$)

Figure 2:
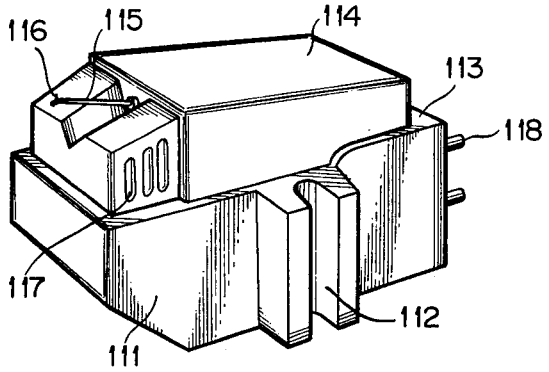
FIG. 2 shows a perspective view of another embodiment of this invention.

Now referring to FIG. 2, another embodiment of a moving magnetic pick up cartridge is shown. The cartridge comprises a casing (113) with a generally flat bottom member and a frame having a pair of screw fixtures (112). On the inner wall of this casing (113), a generating mechanism (114) and yokes are fixed. The outer surface of the generating mechanism is covered with metal shielding material and inside of the casing a pair of yokes facing each other and a generating coil (not shown) are installed, the yokes being fixed at suitable positions with bonding materials or viscoelastic materials. A cantilever (115) in the form of a thin pipe extends from the moving magnet of the generating mechanism toward the outside of the casing and on the top of the cantilever (115), a stylus (116) of diamond or sapphire is mounted. The cantilever and its attached mechanism is removable by handling with a knob (117) when it is necessary. The electric outputs are conducted through terminals (118).

Since the casing is made of a very hard ceramic material, the harmful vibrations involved in the generating mechanism or yokes are diffused smoothly through the ceramic materials. It is also possible to regenerate high fidelity signals.

A method of forming metal ceramic materials into the desired shape for the casing comprises compressing powdered material in a mold of the desired shape. The material is then provisionally sintered, reformed and corrected again and then sintered at high temperature and crystallized to form a very hard ceramic casing.

I claim:

1. In a pick up cartridge comprising: a frame member (11); an elongated cantilever member (17); a stylus (18) mounted to an end of said elongated cantilever member (17); a pair of yokes (15, 16) mounted in said frame member (11) with a space formed between said yokes; a generating mechanism (19) electrically coupled to said cantilever (17); and said cantilever (17) being supported between said yokes and said generating mechanism being fixed near a supporting point of said cantilever, said pair of yokes providing a magnetic field to said mechanism;

the improvement wherein at least a part of said frame member (11) is made of very hard ceramic material.

2. The pick up cartridge of claim 1 wherein said cantilever (17) is supported substantially at the center of the space formed between said pair of yokes.

3. The pick up cartridge of claim 1, further comprising a casing for said generating mechanism and said yokes; and viscoelastic material (25, 26) located between at least one of said yokes (15, 16) and said casing for absorbing vibrations.

4. The pick up cartridge of claim 3 wherein said viscoelastic material is silicone rubber grease which becomes solid at room temperature.

5. The pick up cartridge of any one of claims 1, 2, 3 or 4 wherein said cantilever (17) extends to at least one of said yokes and is supported thereby at a supporting point by said at least one yoke.

6. The pick up cartridge of one of claims 1 or 2 comprising a casing for said generating mechanism and said yokes, at least a part of said casing comprising said frame member (11).

7. The pick up cartridge of any one of claims 1, 2, 3 or 4 wherein said yokes (15, 16) are directly mounted to said frame member (11).

8. The pick up cartridge of any one of claims 1 or 2 wherein said yokes (15, 16) are mounted to said frame member (11) at their fulcrum; and further comprising a mass of viscoelastic material holding at least one of said yokes in position relative to said frame member.

9. The pick up cartridge of claim 8 wherein said cantilever (17) extends to at least one of said yokes and is supported thereby at a supporting point by said at least one yoke.

10. The pick up cartridge of claim 8 comprising a casing for said generating mechanism and said yokes, at least a part of said casing comprising said frame member (11).

11. The pick up cartridge of claim 8 wherein said viscoelastic material is silicone rubber grease which becomes solid at room temperature.

* * * * *